US006012977A

United States Patent [19]

Yoshikawa et al.

[11] Patent Number: 6,012,977

[45] **Date of Patent: *Jan. 11, 2000**

[54] ABRASIVE-BLADED CUTTING WHEEL

[75] Inventors: Masao Yoshikawa; Takehisa Minowa, both of Takefu, Japan

[73] Assignee: Shin-Etsu Chemical Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/996,123

[22] Filed: Dec. 22, 1997

[51] Int. Cl.[7] ..... B28D 1/04

[52] U.S. Cl. ..... 451/541; 451/544; 451/546; 451/28; 451/58; 125/15

[58] Field of Search ..... 451/541, 542, 451/544, 546, 547, 548, 558; 125/15, 28, 58, 69

[56] References Cited

U.S. PATENT DOCUMENTS

| | | | |
|---|---|---|---|
| 3,064,399 | 11/1962 | Anderson | 451/542 |
| 3,590,535 | 7/1971 | Benson et al. | 451/542 |
| 4,212,137 | 7/1980 | Rue | 451/542 |
| 4,739,745 | 4/1988 | Browning | 451/541 |
| 5,495,844 | 3/1996 | Kitajima et al. | 451/541 |
| 5,651,729 | 7/1997 | Benguerel | 451/541 |

OTHER PUBLICATIONS

Japanese Patent Kokai No. 1–164563.
Japanese Patent Kokai No. 62–292366.
Japanese Patent Kokai No. 5–92420.
Japanese Patent Kokai No. 6–238563.

*Primary Examiner*—Eileen P. Morgan
*Attorney, Agent, or Firm*—Dougherty & Troxell

[57] ABSTRACT

Proposed is a cutting wheel bladed on the outer periphery of a base wheel with abrasive particles, e.g., particles of diamond and cubic boron nitride, suitable for cutting of a hard and brittle material such as a sintered block of a rare earth-based magnet alloy with good cutting accuracy and low material loss by cutting. The cutting wheel is an integral disk body consisting of a base wheel of a relatively small thickness made from a cemented metal carbide, e.g., tungsten carbide particles cemented with metallic cobalt, instead of conventional steel materials and a cutting blade formed on the outer periphery of the base wheel which contains from 10 to 80% by volume of the abrasive particles having a specified average particle diameter.

8 Claims, 4 Drawing Sheets

ABRASIVE-BLADED CUTTING WHEEL

BACKGROUND OF INVENTION

The present invention relates to an abrasive-bladed or, in particular, diamond-bladed cutting wheel. More particularly, the invention relates to a cutting wheel bladed on the outer periphery of a base wheel with abrasive particles such as diamond particles and particularly suitable for cutting sintered magnets of a rare earth-based alloy.

It is usual that a sintered block of a rare earth-based alloy magnet is fabricated into desired forms of magnets by cutting with a diamond-bladed cutting wheel. The diamond-bladed cutting wheels currently under practical use for this purpose include two types as grossly classified. A cutting wheel of the first type is formed by bonding fine abrasive particles to the inner periphery of an annular thin base wheel which is a so-called internal-bladed cutting wheel and a cutting wheel of the second type is formed by bonding abrasive particles to the outer periphery of a circular thin base wheel which is a so-called outer-bladed cutting wheel. FIGS. 1A, 1B and 1C illustrate an internal-bladed cutting wheel 1 consisting of an annular base wheel 3 and a cutting blade 4 having a thickness t formed on the inner periphery of the annular base wheel 3. It is a trend in recent years that the major current of the cutting technology for rare earth magnets is to use the cutting wheels of the latter type in view of the higher productivity obtained therewith.

When a large number of magnet products of definite dimensions are produced by cutting a large sintered block of a rare earth-based magnet alloy using a diamond-bladed cutting wheel, one of the major factors to determine the production cost of the magnets is the correlation between the thickness of the cutting wheel and the material yield of the workpiece, i.e. the sintered block of the magnet alloy. Namely, it is important that the cutting wheel used has a thickness as small as possible and the cutting work is conducted with high accuracy so as to reduce the material loss by cutting and to increase the number of the finished magnet pieces taken from a single block.

Needless to say, a diamond-bladed cutting wheel having a small thickness can be prepared only by using a base wheel of a small thickness. In this regard, the internal-bladed cutting wheel is advantageous as compared with the outer-bladed cutting wheel because an internal-bladed cutting wheel is used under rotation by outwardly tensioning the outer periphery of a thin annular base wheel in a slackfree fashion something like a drumhead so that the thickness of the base wheel can be small enough. The base wheel of an internal-bladed cutting wheel can be formed from a thin sheet of a stainless steel having a thickness of about 0.1 mm to which a peripheral cutting blade of 0.25 to 0.5 mm thickness is provided on the inner periphery of the annular base wheel. The base wheel of an outer-bladed cutting wheel under practical use, on the other hand, is formed from an alloy tool steel of the grades SK, SKS, SKD, SKT, SKH and the like specified in a JIS standard. A base wheel made from the above mentioned alloy tool steel and having such a small thickness, however, does not have a high mechanical strength suitable for cutting of sintered rare earth magnet blocks having a high hardness so that the cutting wheel under working unavoidably causes warping and undulation not to give a high cutting accuracy. Moreover, sintered rare earth magnet blocks in general have a higher hardness than that of the above mentioned alloy tool steels so that the base wheel is eventually damaged by the chips formed by cutting from the sintered block and jammed between the base wheel and the workpiece to decrease the durability of the cutting wheel or to increase warping or undulation of the base wheel.

SUMMARY OF THE INVENTION

The present invention has an object, in view of the above described problems and disadvantages in the conventional diamond-bladed cutting wheels of the prior art, to provide a novel and improved diamond-bladed cutting wheel of the outer-bladed type having high durability and capable of giving a high accuracy of cutting works with an outstandingly small material loss by cutting to be particularly suitable for the cutting works of a sintered magnet block of a rare earth-based alloy.

Thus, the abrasive-bladed cutting wheel provided by the present invention is an integral body generally in the form of a disk consisting of (a) a base wheel made from a cemented metal carbide having a Young's modulus in the range from 45000 to 70000 kgf/mm$^2$ and having a thickness in the range from 0.1 mm to 1 mm and (b) an abrasive particle-containing cutting blade formed on the outer periphery of the base wheel, the cutting blade containing from 10 to 80% by volume of the abrasive particles having an average particle diameter in the range from 10 to 500 $\mu$m.

DETAILED DESCRIPTION OF THE PREFERRED EMBODIMENTS

Figure 1A:
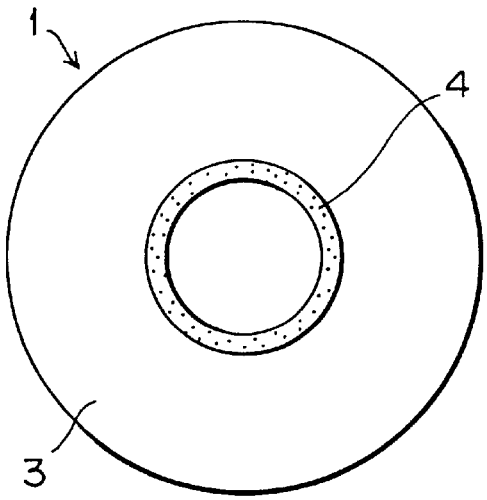
FIG. 1A PRIOR ART
FIG. 1A is a plan view of a diamond-bladed cutting wheel of the internal-blade type.
Figure 1B:
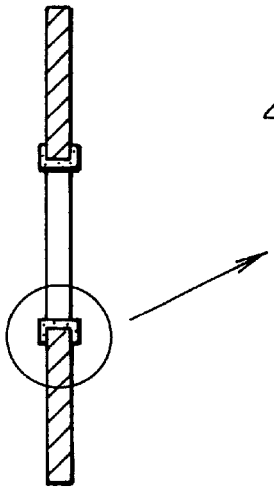
FIG. 1B PRIOR ART
FIG. 1B is an axial cross sectional view of the wheel illustrated in FIG. 1A
Figure 1C:
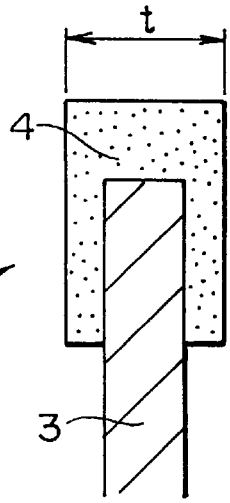
FIG. 1C PRIOR ART
FIG. 1C is a partial enlargement thereof.

As is understood from the above given summarizing description, the most characteristic feature of the inventive abrasive-bladed cutting wheel is that the base wheel thereof is made from a cemented metal carbide and that a continuous cutting blade formed on the outerperiphery of the base wheel contains from 10 to 80% by volume of abrasive particles having a specified average particle diameter.

It is generally understood that one of the most important factors influencing the results of cutting works of a very hard material such as a sintered magnet block of a rare earth-based alloy by using an abrasive-bladed cutting wheel is the material of the base wheel having a small thickness. The inventors have conducted extensive investigations to select a material of the base wheel which is highly resistant against warping and undulation even under a high stress in the cutting works as compared with base wheels made from conventional alloy tool steels and, as a result, have arrived at an unexpected discovery that several kinds of cemented metal carbides are the most suitable for the purpose. Needless to say, the hardness of these cemented metal carbides is not high as compared with ceramic materials such as alumina and the like which, however, are inferior in the toughness so that these ceramic materials are not suitable as the material of base wheels because a cutting wheel made with a ceramic-made thin base wheel would readily be cracked during cutting works of sintered rare earth magnet blocks to cause a great danger on the worker.

The cemented metal carbide here implied is a composite material consisting of a powder of a carbide of a metal belonging to the Groups IVα, Va or VIα of the Periodic Table such as tungsten carbide WC, titanium carbide TiC, molybdenum carbide MoC, niobium carbide NbC, tantalum carbide TaC, chromium carbide $Cr_3C_2$ and the like cemented, for example, by the admixture of a powder of a metal such as iron, cobalt, nickel, molybdenum, copper, lead, tin and the like or an alloy thereof, of which those consisting of tungsten carbide cemented with cobalt, tungsten carbide and titanium carbide in combination cemented with cobalt and tungsten carbide, titanium carbide and, tantalum carbide in combination cemented with cobalt are typical and tungsten carbide cemented with cobalt is preferable although the cemented carbide alloy from which the base wheel of the inventive cutting wheel is not particularly limitative thereto. It is essential in the invention that the base wheel made from the cemented metal carbide has a Young's modulus in the range from 45000 to 70000 kgf/mm$^2$ because, when the Young's modulus is too low, the cutting wheel is not free from the troubles due to warping and undulation during the cutting works unless the thickness of the base wheel is increased so large that the advantages to be obtained by the use of a cemented carbide alloy would be lost while, when the Young's modulus of the base wheel is too high, the cutting wheel is subject to eventual cracking during the cutting works due to undue brittleness of the base wheel although the cutting wheel can be free from the troubles of warping and undulation.

Figure 2A:
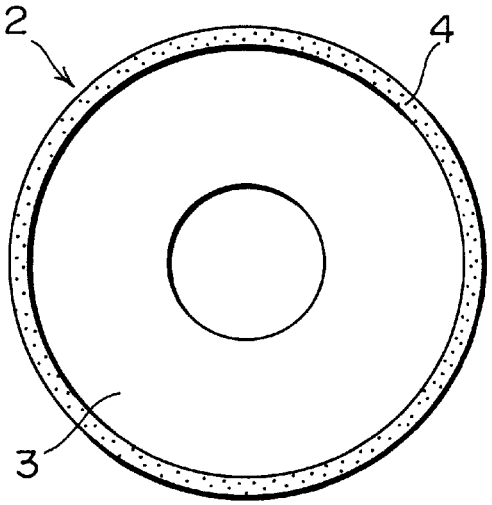
FIG. 2A is a plan view of a diamond-bladed cutting wheel of the outer-blade type.
Figure 2B:
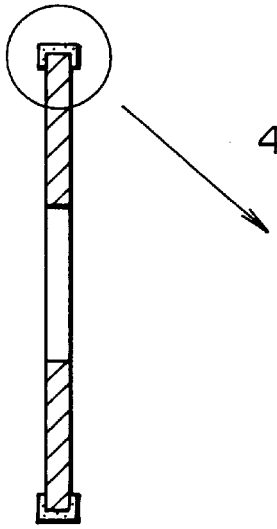
FIG. 2B is an axial cross sectional view of the wheel illustrated in FIG. 2A
Figure 2C:
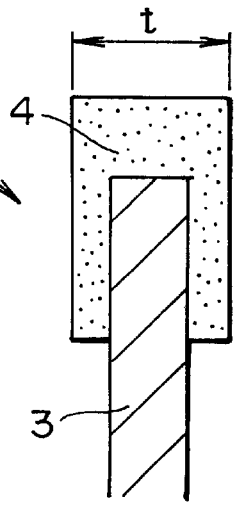
FIG. 2C is a partial enlargement thereof.

FIGS. 2A, 2B and 2C illustrate the abrasive-bladed cutting wheel of the invention by a plan view, an axial cross sectional vies and an enlarged partial cross sectional view, respectively. Namely, the abrasive-bladed cutting wheel 2 is a composite body consisting of a base wheel 3 made from a cemented metal carbide and a cutting blade 4 having a thickness t formed by bonding particles of an abrasive powder such as diamond particles with a bonding agent onto the outer periphery of the base wheel 3. The method for bonding of the abrasive particles is not particularly limitative including metal bonding, resin bonding, vitrified bonding and electrodeposition bonding. It is essential that the volume fraction of the abrasive particles or, in particular, diamond particles in the abrasive-containing cutting blade 4 is in the range from 10% to 80%. When the volume fraction of the abrasive particles is too low, the cutting performance of the cutting wheel 2 is unduly decreased due to deficiency in the amount of the abrasive particles resulting in a disadvantage of consumption of longer working times for cutting. When the volume fraction of the abrasive particles is too large or, in other words, the volume fraction of the bonding agent is too small, the abrasive particles cannot be firmly held on the periphery of the base wheel with a sufficiently high bonding strength so that falling of the abrasive particles may eventually be caused during the cutting work of a high-hardness workpiece such as sintered rare earth alloy-based magnet blocks.

Examples of the abrasive powder used in the inventive abrasive-bladed cutting wheel include particles of natural diamond and synthetic diamond of technical grade and particles of cubic boron nitride, referred to as cBN hereinafter, as well as blends of these abrasive particles. cBN is known as a next hardest material to diamond and is rather more stable against heat and less reactive to steels than diamond. Accordingly, it is an advantageous way to substitute cBN particles for a part or all of diamond particles in the abrasive powder used in the abrasive-bladed cutting wheel of the invention used for cutting of rare earth alloy-based sintered magnet blocks without any decrease in the cutting performance of the cutting wheel.

Studies have further been undertaken for the particle size of the abrasive particles used in the inventive abrasive-bladed cutting wheel to find that the abrasive particles of diamond and cBN should have an average particle diameter in the range from 10 to 500 $\mu$m in the cutting wheel used for sintered blocks of a rare earth alloy-based magnet. The actual particle diameter of the abrasive particles is selected in this range in consideration of the nature of the cutting works, thickness of the base wheel and other factors. When the abrasive particles are too fine, the efficiency of the cutting work is decreased because the surface of the cutting blade is readily clogged as a consequence of little ejection of the abrasive particles on the surface while, when the abrasive particles are too coarse, the surface of the workpiece as cut is correspondingly rough and, even with a base wheel having a thickness small enough, the thickness t of the cutting blade on the periphery of the base wheel cannot be small enough so that the requirement for decreasing the material loss by cutting cannot be satisfied even though the cutting performance with the cutting wheel can be quite satisfactory.

Needless to say, it is very essential that the base wheel is absolutely free from any warping and undulation because, with a cutting wheel formed by using a base wheel having warping or undulation is used for cutting of sintered blocks of a rare earth alloy-based magnet, the magnet products obtained by cutting necessarily have a low dimensional accuracy with a large material loss by cutting. This problem due to warping or undulation of the base wheel is very serious as the thickness of the base wheel is decreased and the diameter of the base wheel is increased so that a base wheel having high dimensional accuracy can hardly be obtained. In this regard, the base wheel of a cemented metal carbide is advantageous as compared with conventional materials so that a base wheel has a diameter not exceeding 250 mm and a thickness in the range from 0.1 to 1 mm can easily be obtained and quite satisfactory results can be accomplished therewith in the cutting works of sintered blocks of a rare earth alloy-based magnet with high dimensional accuracy of cutting and with stability in a service over a long time. When the outer diameter of the base wheel exceeds 250 mm or when the thickness thereof is smaller than 0.1 mm, the base wheel would suffer a decrease in the dimensional accuracy due to occurrence of large warping. When the thickness of the base wheel exceeds 1 mm, the merit to be obtained by the use of a base wheel of a cemented metal carbide would be lost because, even if the large material loss by cutting due to the use of a cutting wheel of such a large thickness is permissible, a conventional cutting wheel with a base wheel of an alloy tool steel could well meet the purpose of high-accuracy cutting of a sintered block of a rare earth alloy-based magnet.

Incidentally, the above mentioned upper limit of 250 mm of the diameter of the base wheel is a value corresponding to 40 mm of the diameter of the rotating shaft to penetrate the center opening of the base wheel. When the rotating shaft has a smaller diameter, it would be better to have a smaller outer diameter of the base wheel correspondingly.

The abrasive-bladed cutting wheel of the present invention is particularly suitable for the cutting works of a sintered block of a rare earth alloy-based magnet as the workpiece. Examples of the rare earth alloy-based magnets include those of the rare earth-cobalt alloys and rare earth-iron-boron alloys. These rare earth alloy-based magnets are prepared by the following procedures.

The rare earth-cobalt alloys for sintered magnets are classified into $RCo_5$ type and $R_2Co_{17}$ type, R being a rare earth element, of which the major current in recent years is for the magnets of the $R_2Co_{17}$ type. Such a rare earth-cobalt magnet alloy of the $R_2Co_{17}$ type consists of from 20 to 28% by weight of a rare earth metal, from 5 to 30% by weight of iron, from 3 to 10% by weight of copper and from 1 to 5% by weight of zirconium, the balance being cobalt. Thus, these metallic ingredients are taken in a specified weight proportion and melted together to be cast into an ingot and the thus obtained ingot is finely pulverized into particles having an average particle diameter in the range from 1 to 20 $\mu$m. The alloy powder is compression-molded in a magnetic field into a green body which is subjected first to a sintering treatment at a temperature of 1100 to 1250° C. for 0.5 to 5 hours, then to a solubilization treatment for 0.5 to 5 hours at a temperature by up to 50° C. lower than the sintering temperature and finally to an aging treatment which is performed in multistages consisting of the first stage at 700 to 950° C. for a certain length of time followed by continuous cooling or multistage aging.

The alloy for the rare earth-iron-boron sintered magnets usually consists of from 5 to 40% by weight of a rare earth metal, 50 to 90% by weight of iron and from 0.2 to 8% by weight of boron with optional addition of one or more of the additive elements selected from carbon, aluminum, silicon, titanium, vanadium, chromium, manganese, cobalt, nickel, copper, zinc, gallium, zirconium, niobium, molybdenum, silver, tin, hafnium, tantalum and the like with an object to improve the magnetic properties and corrosion resistance of the magnets. The amount of these additive elements is 30% by weight or less for cobalt and 8% by weight or less for each of the other additive elements. The magnetic properties of the magnets would be rather decreased by the addition of a larger amount of these additive elements. The procedure for the preparation of a rare earth-iron-boron sintered magnet is about the same as in the preparation of the above mentioned rare earth-cobalt sintered magnet except that the sintering treatment is performed at 1000 to 1200° C. for 0.5 to 5 hours followed by an aging treatment at 400 to 1000° C.

In the following, the abrasive-bladed cutting wheel of the invention is described in more detail by way of Examples and Comparative Examples which, however, never limit the scope of the invention in any way.

EXAMPLE 1 AND COMPARATIVE EXAMPLE 1

An annular disc having a thickness of 0.4 mm, outer diameter of 125 mm and inner diameter of 40 mm to serve as a base wheel was prepared in Example 1 from a cemented metal carbide consisting of 90% by weight of tungsten carbide and 10% by weight of cobalt and having a Young's modulus of 58000 kgf/mm$^2$. Synthetic diamond particles having an average particle diameter of 150 $\mu$m were bonded by the resin bond method onto the outer periphery of the base wheel to form a cutting blade of which the volume fraction of the diamond particles was 25%, the balance being the resin. Thus, the base wheel was set in a metal mold for the cutting wheel and the space around the outer periphery of the base wheel was filled with a blend of the diamond particles and a thermosetting phenolic resin as the binder and the diamond-resin blend was compression-molded and heated under the molding pressure for 2 hours at 180° C. in the metal mold to effect curing of the phenolic resin and bonding of the cured resin onto the outer periphery of the base wheel to form a cutting blade which was dressed on a lapping table into a blade thickness of 0.5 mm to finish a diamond-bladed cutting wheel.

The dimensions and the preparation procedure of a diamond-bladed cutting wheel in Comparative Example 1 were substantially the same as in Example 1 described above except that the base wheel was shaped from an alloy tool steel of the grade SKD specified in JIS instead of the cobalt-cemented tungsten carbide.

Figure 3A:
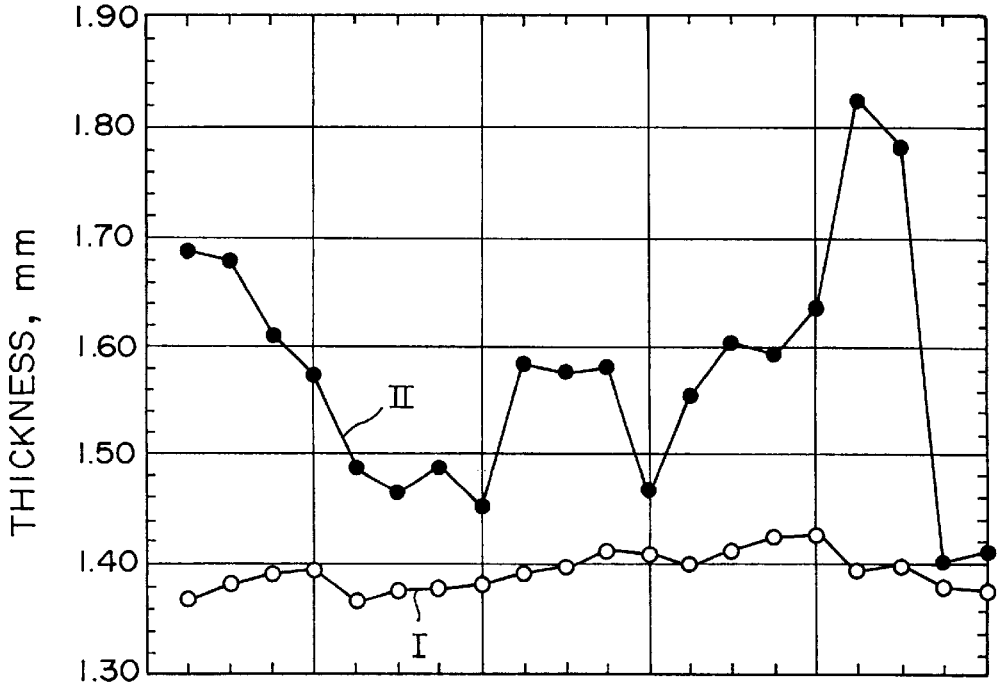
FIGS. 3A and 3B are each a graph showing the thickness of sliced magnets and deviation of the variation in the thickness, respectively, as a function of the number of cutting in Example 1 and Comparative Example 1.
Figure 3B:
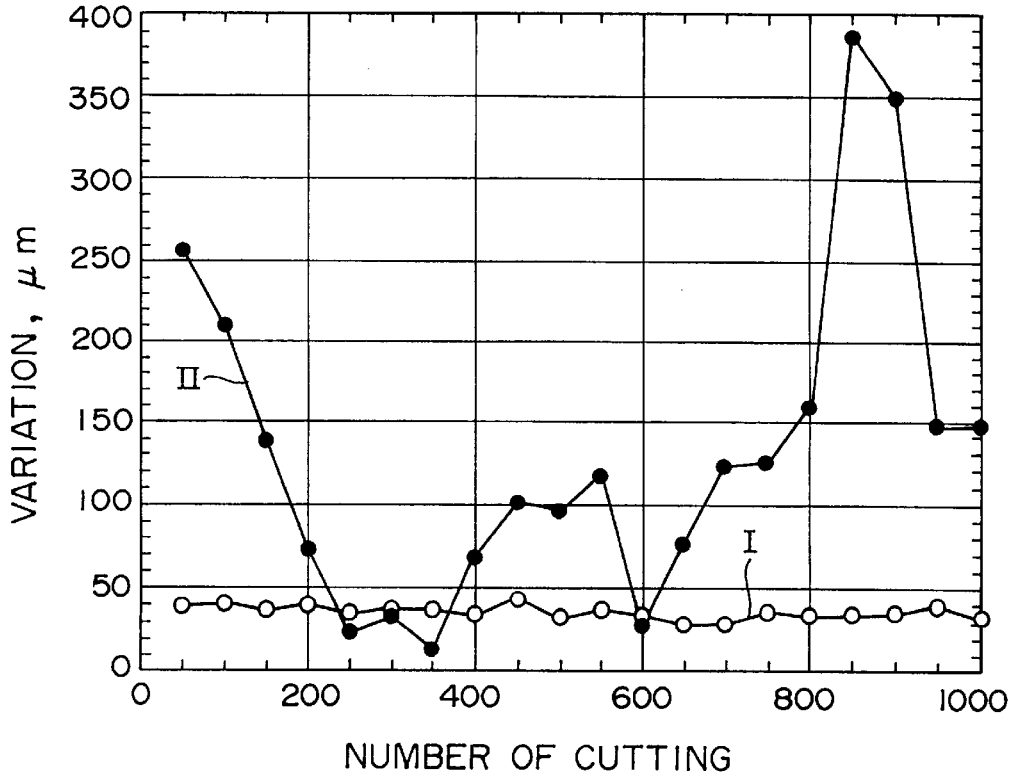

Cutting tests were undertaken for the diamond-bladed cutting wheels prepared in Example 1 and Comparative Example 1 by slicing a sintered block of a neodymium-iron-boron magnet as the workpiece. FIG. 3A shows the thickness of the sliced pieces as a function of the number of repeated cuttings by the curves I and II for Example 1 and Comparative Example 1, respectively. FIG. 3B shows the deviation in the thickness of the sliced pieces from the target value as a function of the number of repeated cuttings by the curves I and II for Example 1 and Comparative Example 1, respectively.

The procedure for the cutting test was as follows. Thus, two of the cutting blades prepared in Example 1 or Comparative Example 1 were assembled in multi-setting at a distance of 1.5 mm for a target thickness of 1.4 mm and the workpiece was sliced with the cutting blades rotating at 5000 rpm with a cutting rate of 12 mm/minute. The cutting area of the workpiece was 40 mm width by 20 mm height. Sampling was made for a magnet specimen as cut each from consecutive 50 cuttings and the thickness of each magnet specimen was determined at five points including the center point and four diagonal points in the vicinity of the corners by using a micrometer. The value obtained for the center point was taken as the thickness of the magnet specimen shown in FIG. 3A and the difference between the largest value and the smallest value was taken as the degree of parallelism representing the variation in thickness shown in FIG. 3B.

As is understood from FIGS. 3A and 3B, the cutting work could be conducted with high accuracy and stability for a large number of cuttings in the thickness of the magnet specimens when the diamond-bladed cutting wheels of the invention is used as compared with conventional cutting wheels despite the small thickness of the cutting wheel.

EXAMPLE 2 AND COMPARATIVE EXAMPLE 2

An annular disc having a thickness of 0.3 mm, outer diameter of 80 mm and inner diameter of 40 mm to serve as a base wheel was prepared in Example 2 from a cemented metal carbide consisting of 80% by weight of tungsten carbide and 20% by weight of cobalt and having a Young's modulus of 50000 kgf/mm$^2$. Synthetic diamond particles having an average particle diameter of 100 $\mu$m and particles of cBN as mixed in a weight ratio of 1:1 were bonded by the metal bond method onto the outer periphery of the base wheel using a 70:30 by weight mixture of copper powder and tin powder as the bonding agent to form a cutting blade having a blade thickness of 0.4 mm of which the volume fraction of the abrasive particles was 15%, the balance being the metallic bonding agent. The heat treatment of the cutting blade as formed by compression molding was performed at 700° C. for 2 hours followed by dressing.

The dimensions and the preparation procedure of an abrasive-bladed cutting wheel in Comparative Example 2 were substantially the same as in Example 2 described above except that the base wheel was shaped from a high-speed steel of the grade SKH instead of the cobalt-cemented tungsten carbide.

Figure 4A:
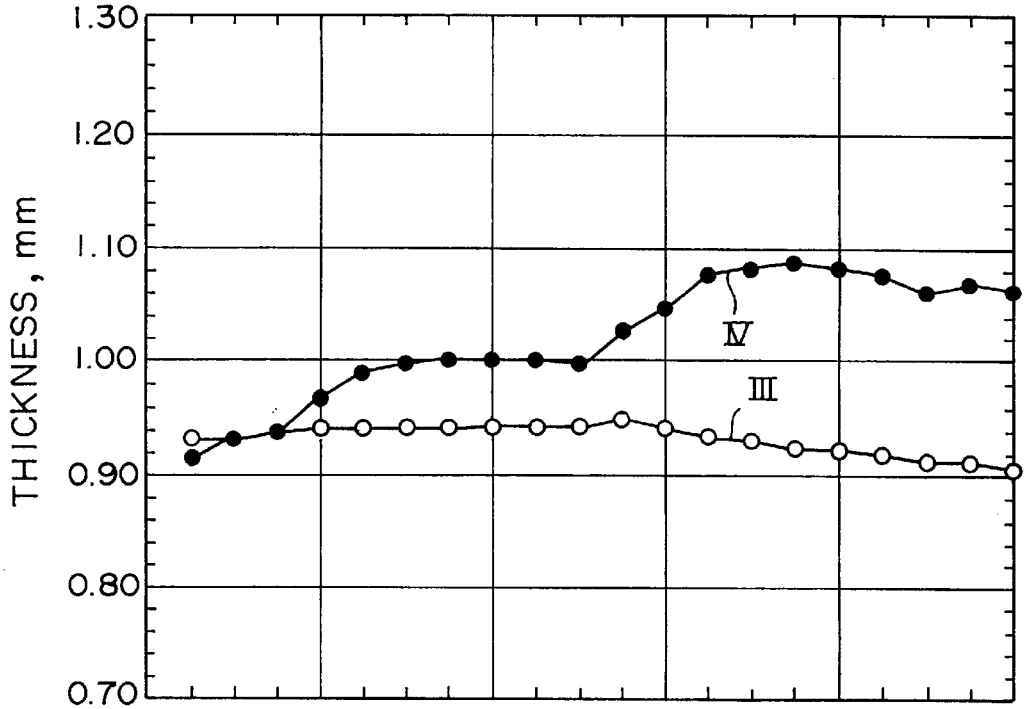
FIGS. 4A and 4B are each a graph showing the thickness of sliced magnets and deviation of the variation in the thickness, respectively, as a function of the number of cutting in Example 2 and Comparative Example 2.
Figure 4B:
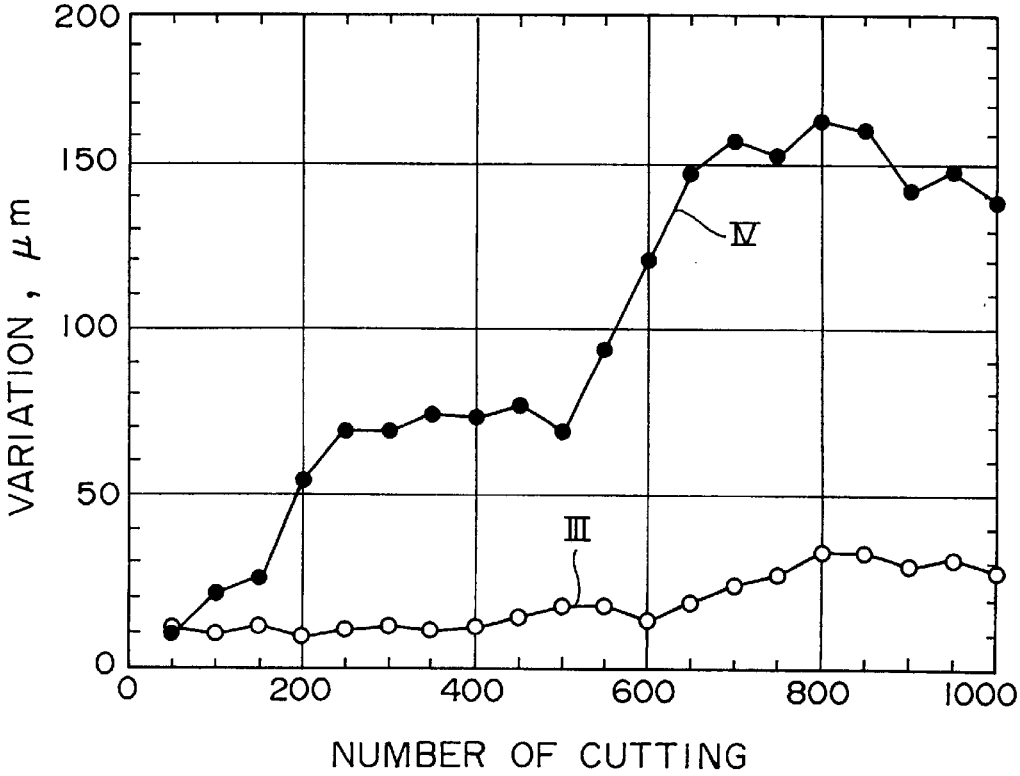

Cutting tests were undertaken for the abrasive-bladed cutting wheels prepared in Example 2 and Comparative Example 2 by slicing a sintered block of a samarium-cobalt magnet as the workpiece. FIG. 4A shows the thickness of the sliced pieces as a function of the number of repeated cuttings by the curves Ill and IV for Example 2 and Comparative Example 2, respectively. FIG. 4B shows the variation in the thickness of the sliced pieces as a function of the number of repeated cuttings by the curves III and IV for Example 2 and Comparative Example 2, respectively.

The procedure for the cutting test was substantially the same as in Example 1 and Comparative Example 1 except that the two cutting wheels was assembled at a distance of 1.0 mm with a target thickness of the slices of 0.9 mm, revolution of the cutting wheels was 5000 rpm, cutting rate was 8 mm/minute and cutting area of the workpiece was 50 mm width by 10 mm height.

EXAMPLE 3 AND COMPARATIVE EXAMPLE 3

An annular disc having a thickness of 0.5 mm, outer diameter of 150 mm and inner diameter of 40 mm to serve as a base wheel was prepared in Example 3 from a cemented metal carbide consisting of 85% by weight of tungsten carbide and 15% by weight of cobalt and having a Young's modulus of 55000 kgf/mm$^2$. Synthetic diamond particles having an average particle diameter of 50 $\mu$m were bonded by the electrodeposition bond method using a nickel-Watts electrolytic bath onto the outer periphery of the base wheel to form a cutting blade having a thickness of 0.6 mm of which the volume fraction of the diamond particles was controlled to 40%, the balance being nickel as the bonding medium, by taking an adequate length of time for the electrodeposition to obtain an appropriate plating thickness.

The dimensions and the preparation procedure of a diamond-bladed cutting wheel in Comparative Example 3 were substantially the same as in Example 3 described above except that the base wheel was shaped from a high-speed steel of the grade SKH instead of the cobalt- cemented tungsten carbide.

Figure 5A:
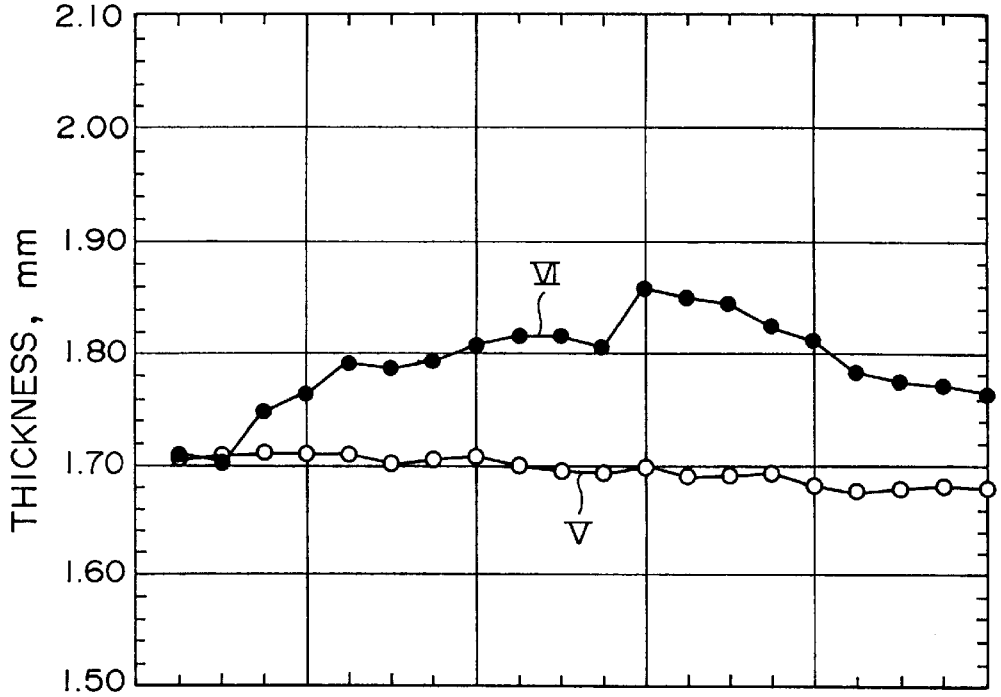
FIGS. 5A and 5B are each a graph showing the thickness of sliced magnets and deviation of the variation in the thickness, respectively, as a function of the number of cutting in Example 3 and Comparative Example 3.
Figure 5B:
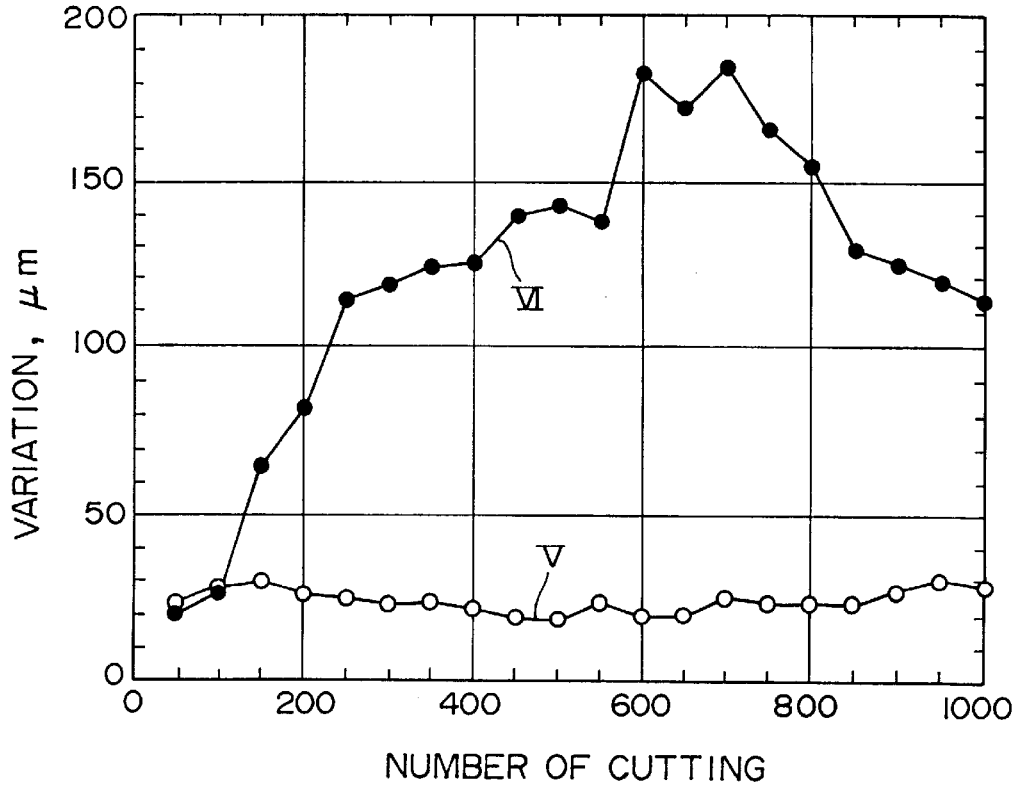

Cutting tests were undertaken for the diamond-bladed cutting wheels prepared in Example 3 and Comparative Example 3 by slicing a sintered block of a neodymium-iron-boron magnet alloy as the workpiece. FIG. 5A shows the thickness of the sliced pieces as a function of the number of repeated cuttings by the curves V and VI for Example 3 and Comparative Example 3, respectively. FIG. 5B shows the variation in the thickness of the sliced pieces as a function of the number of repeated cuttings by the curves V and VI for Example 3 and Comparative Example 3, respectively.

The procedure for the cutting test was substantially the same as in Example 1 and Comparative Example 1 except that the two cutting wheels was assembled at a distance of 1.8 mm with a target thickness of the slices of 1.7 mm, revolution of the cutting wheels was 5500 rpm, cutting rate was 15 mm/minute and cutting area of the workpiece was 50 mm width by 30 mm height.

What is claimed is:

1. A cutting wheel having abrasive particles on the outer periphery for cutting a rare earth magnet, said cutting wheel comprising a base wheel and a continuous cutting blade portion forming an outer periphery of said cutting wheel, and abrasive particles contained in said cutting blade portion along the outer periphery for cutting rare earth magnets, said base wheel including said cutting blade portion made from a cemented metal carbide in the form of an annular thin disk having a center opening and a thickness in the range from 0.1 mm to 1.0 mm and wherein said abrasive particles are contained in said cutting blade portion along the outer periphery of said base wheel in a volume proportion of 10 to 80%.

2. A cutting wheel according to claim 1 in which the cemented metal carbide has a Young's modules in the range from 45,000 to 70,000 Kgf/mm$^2$.

3. A cutting wheel according to claim 1 in which the base wheel has an outer diameter not exceeding 250 mm.

4. A cutting wheel according to claim 1 in which the cemented metal carbide is formed from particles of tungsten carbide cemented with cobalt.

5. A cutting wheel according to claim 1 in which the abrasive particles are particles of diamond, particles of cubic boron nitride or combinations thereof.

6. A method for cutting sintered blocks of rare earth alloy based magnets with high dimensional accuracy and minimal material loss comprising the steps of:

a) forming a cemented metal carbide annular disk-shaped cutting wheel including a base wheel having a center opening and a continuous cutting blade portion in an outer periphery thereof wherein the abrasive particles are contained in the cutting blade portion in a volume portion of 10 to 80% and wherein the thickness of the base wheel is within the range of 0.1 mm to 1.0 mm;

b) providing a sintered block of rare earth alloy based magnet material; and c) slicing the rare earth alloy based magnet material by rotating the cutting wheel and subjecting the magnetic material to the outer periphery of the cutting blade portion as the annular disk is rotated.

7. A method for cutting sintered blocks of rare earth alloy based magnets according to claim 6 in which the cemented metal carbide annular disk-shaped cutting wheel formed in step a) is formed with an outer diameter not exceeding 250 mm.

8. A method for cutting sintered blocks of rare earth alloy based magnets according to claim 7 in which the abrasive particles are diamond, cubic boron carbide or mixtures thereof.

* * * * *